United States Patent [19]

Gammarino et al.

[11] Patent Number: 4,823,401

[45] Date of Patent: Apr. 18, 1989

[54] "MILES" TRANSCEIVER DISPLAY CONTROLLER UNIT

[75] Inventors: Rudolph R. Gammarino, Pasadena; Mark S. Doerning, Arcadia; Barry J. Cuccia, Placentia, all of Calif.

[73] Assignee: Applied Solar Energy Corporation, City of Industry, Calif.

[21] Appl. No.: 128,800

[22] Filed: Dec. 4, 1987

[51] Int. Cl.[4] ..... H04B 9/00

[52] U.S. Cl. ..... 455/606; 362/112; 89/41.06; 273/310; 455/617

[58] Field of Search ..... 455/603, 606, 607, 608, 455/609, 617, 618, 619; 434/21, 22; 362/110-114; 89/41.01, 41.06; 273/310, 313, 316, 311, 312, 314, 315

[56] References Cited

U.S. PATENT DOCUMENTS

| | | | |
|---|---|---|---|
| 4,352,665 | 10/1982 | Kimble et al. | 434/22 |
| 4,487,583 | 12/1984 | Brucker et al. | 434/22 |
| 4,586,715 | 6/1986 | Scolari | 362/113 |
| 4,695,058 | 9/1987 | Carter | 434/22 |

*Primary Examiner*—Benedict V. Safourek
*Assistant Examiner*—Leslie Van Beek
*Attorney, Agent, or Firm*—Poms, Smith, Lande & Rose

[57] ABSTRACT

A transmitter and receiver for "MILES" type systems is in a pistol type configuration, and is provided with a display, to indicate the mode of the controller unit, as well as the specific MILES codes which are transmitted or received. The versatile unit is particularly flexible in its ability to test the various components of Multiple Integrated Laser Engagement System, with "MILES" being the acronym for these combat training exercise systems. A continuous rotary control switch determines the mode, either (1) transmit, (2) receive, or (3) identity change. In the transmit mode, rotation of the switch will change the transmitted MILES code, and actuation of the trigger switch will transmit the MILES code and an associated identity code. In the identity change mode, operating the trigger switch will change the I.D. number of the "player". In the receive mode, the display will show the received MILES code, and the player identity number. The light emitting output from the unit may be a light-emitting diode or a laser and the detector may be a hybrid amplifier/detector, including a photodiode and an amplifier, provided with a plastic cover serving both as protection for the diode and also as a filter. The unit may be provided with a buzzer to indicate the receipt of a MILES code signal.

19 Claims, 3 Drawing Sheets

FIG. 1
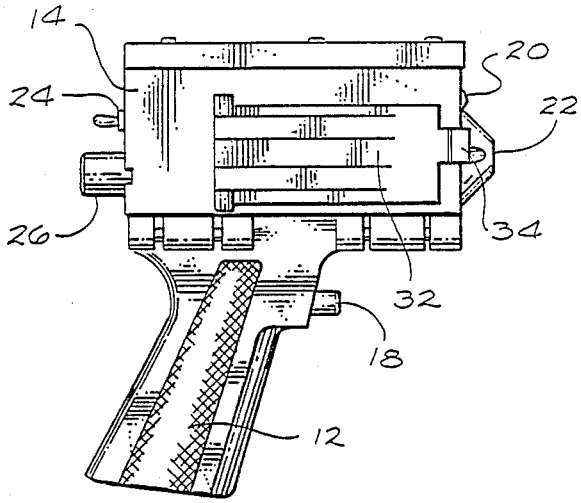
FIG. 2
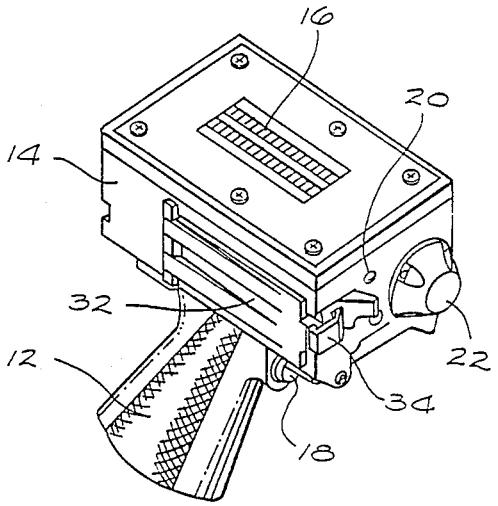
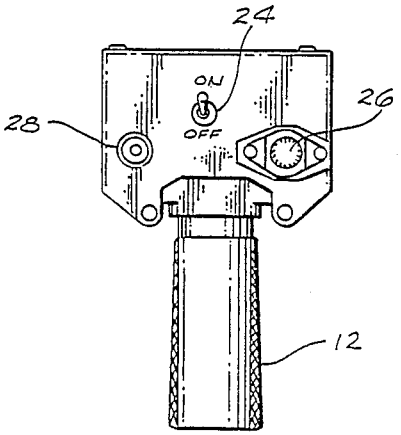
FIG. 3

"MILES" TRANSCEIVER DISPLAY CONTROLLER UNIT

FIELD OF THE INVENTION

This invention relates to control units for receiving and transmitting "MILES" type signals, and for displaying the received and transmitted signals.

BACKGROUND OF THE INVENTION

For simulating military combat situations without actually firing live ammunition, laser systems have been developed, using relatively low power lasers and matched detectors for indicating when a "hit" has occurred. These systems are known as "MILES" systems, with the acronym "MILES" standing for Multiple Integrated Laser Engagement Systems. Another acronym used for one aspect of the MILES program is "AGES", standing for Air-to-Ground Engagement Simulation.

In working with MILES systems, the laser beam is modulated to indicate the type of weapon which is the source of the laser beam; and a player identification number may also be included in the transmitted signal. When a player is "hit" and has received a valid MILES code, an indication is given such as the sounding of a horn.

Failure of MILES transmitters and/or detection systems would significantly reduce the value of combat exercises; and it has been difficult and time-consuming, up to the advent of the present invention, to easily check the operativeness of MILES systems.

Accordingly, a principal object of the present invention is to provide a hand-held controller with a visual display for simply and conveniently either (1) transmitting and displaying, or (2) receiving and displaying, MILES signals.

SUMMARY OF THE INVENTION

In accordance with the present invention, a hand-held controller unit for use with MILES type simulated warfare systems includes both detector arrangements for receiving input coded MILES signals, and also light-emitting means for transmitting coded MILES signals including a weapon code, and which may also include an identity code. A display is provided on the unit for displaying MILES code information, either indicating the identifying information to be transmitted when the unit is in the "transmit" mode; or for displaying information identifying the received MILES code signals when the unit is in the "receive" mode. In addition, electronic circuitry is provided for decoding the input signals, and applying appropriate signals to the displaying arrangements when the unit is in the "receive" mode, and for similarly displaying the desired MILES code prior to transmission when the unit is in the "transmit" mode.

In accordance with additional features of the invention, the hand-held unit may include various electrical switches for switching the unit from the transmit mode to the receive mode, and for changing the signal to be transmitted, when the unit is in the transmit mode, and optionally including changing the "player" identity code.

In accordance with an additional feature of the invention, the controller unit may have a pistol-type configuration, and one of the operating switches may be the trigger of the pistol-style unit.

In accordance with another aspect of the invention, one of the switches may be rotatable in either direction, with rotation scrolling the MILES code through its many alternative weapons code indications, when the unit is in the transmit mode, and the corresponding signal to be transmitted by the unit. The player identity code may also be changed, and may be transmitted along with the weapons code information.

In accordance with a further aspect of the invention, both the detector, and the light-emitting arrangements, which may be a light-emitting diode, may be mounted on the forward protruding portion of the pistol-type unit. In accordance with a further aspect of the invention, the unit may be equipped with a buzzer or other audible signal, indicating the receipt of a MILES code signal, or the transmission of a MILES code.

In accordance with a further subordinate feature of the invention, the display on the unit may be a liquid crystal display, to minimize power consumption of the battery powered unit.

Other objects, features, and advantages of the invention will become apparent from a consideration of the following detailed description and from the accompanying drawings.

BRIEF DESCRIPTION OF THE DRAWINGS

FIG. 1, is a side elevational view of a transceiver controller unit illustrating the principles of the present invention;

FIG. 2/ is a front perspective view of the controller unit of FIG. 1;

FIG. 3 is a rear view of the controller unit of FIGS. 1 and 2;

DETAILED DESCRIPTION

Figure 4:
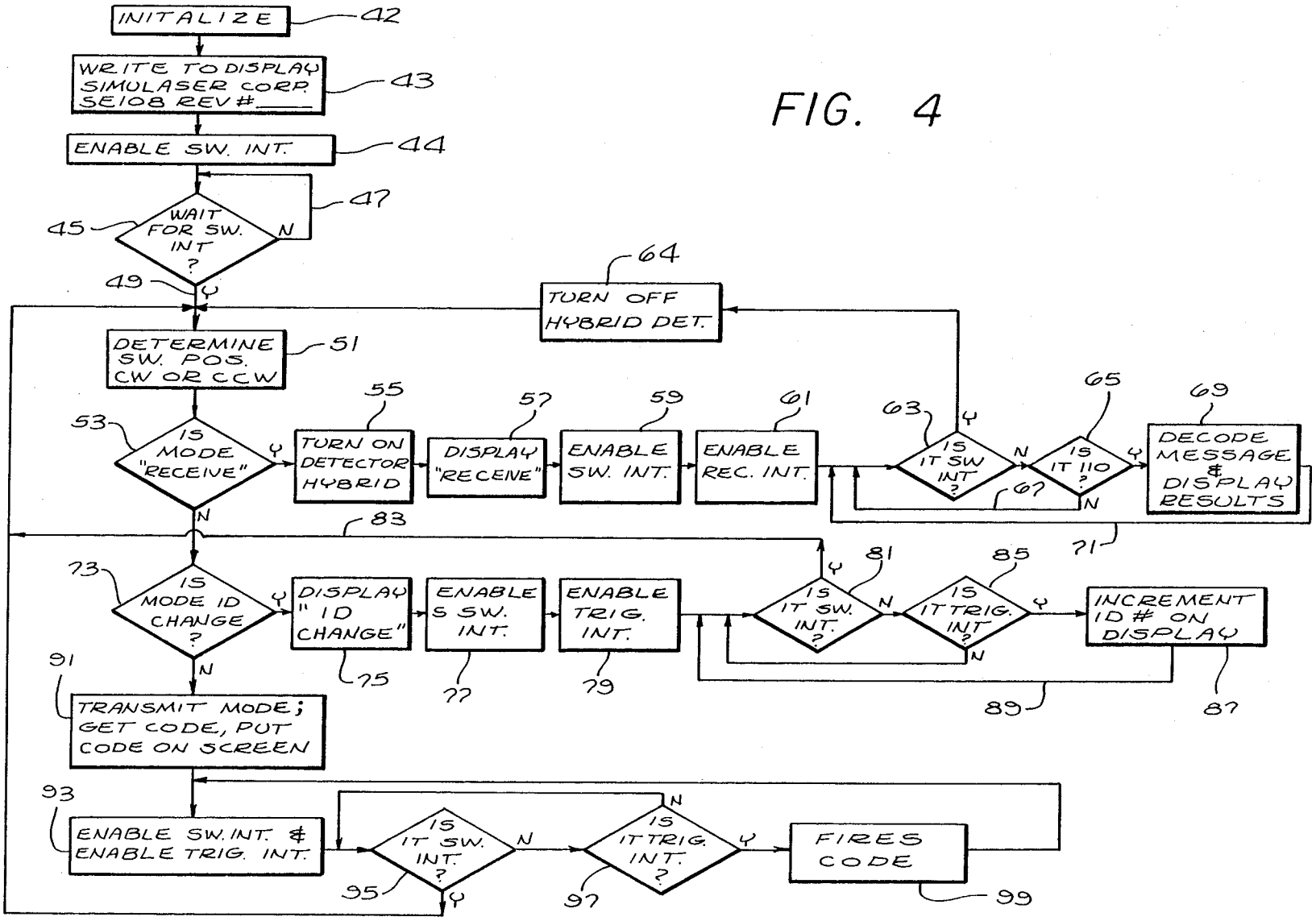
FIG. 4 is a block diagram setting forth the mode of operation of the controller unit of FIGS. 1 through 3.

Referring more particularly to FIGS. 1 through 3 of the drawings, the controller unit of the present invention includes a handle 12, and an upper body portion 14 containing the electronic circuitry to be discussed in greater detail in connection with FIG. 5 of the drawings, and a liquid crystal display 16 which is on the top of the unit. A trigger switch 18 is provided for initiating an output signal from the light-emitting diode 20 which is mounted in the front face of the unit. A detector unit 22 includes an outer combined protective housing and filter, and a semi-conductive photodiode mounted within the protective housing.

The rear of the unit, as shown in FIG. 3, includes an on-off switch 24, and a ten position rotary switch 26. In addition, a buzzer or beeper 28 is provided on the rear surface of the housing 14, to indicate that a MILES signal has been received, or has been transmitted.

The liquid crystal display 16 includes two rows of 16 alpha-numeric characters each, for displaying desired information such as the weapon identification and/or the identity of the particular player managing the transmitting weapon.

At the front right side of the controller housing 14, when viewing the unit from the rear, there is a panel 32 into which a nine volt battery may be inserted to power the unit. It is provided with a simple clamping mechanism 34 to hold the panel 32 closed.

For completeness, the MILES code structure will be set forth in the following Table No. 1.

TABLE NO. 1

MILES CODE STRUCTURE

| DATA BITS | | | | | | | | | | | STD. MILES CODE | NTC CODE | |
|---|---|---|---|---|---|---|---|---|---|---|---|---|---|
| 0 | 1 | 2 | 3 | 4 | 5 | 6 | 7 | 8 | 9 | 10 | NO. | NO. | WEAPON/FUNCTION |
| 1 | 1 | 0 | 0 | 0 | 1 | 0 | 1 | 1 | 0 | 1 | 00 | 00 | UNIV. KILL, CONTR. GUN 100% KILL |
| 1 | 1 | 0 | 1 | 0 | 0 | 1 | 0 | 0 | 1 | 1 | 01 | 01 | MAVERICK HIT |
| 1 | 1 | 0 | 0 | 0 | 1 | 1 | 0 | 1 | 0 | 1 | 02 | 02 | HELLFIRE HIT |
| 1 | 1 | 0 | 0 | 0 | 1 | 0 | 1 | 0 | 1 | 1 | 03 | 03 | AT-3 SAGGER (NTC-BMP) HIT |
| 1 | 1 | 0 | 0 | 1 | 0 | 1 | 0 | 0 | 1 | 1 | 04 | 04 | 60 MM, 81 MM, 4.2 INCH HIT |
| 1 | 1 | 0 | 1 | 0 | 1 | 0 | 1 | 0 | 0 | 1 | 05 | ** | M15A MINE (TRACK CUTTER) HIT |
| 1 | 1 | 0 | 0 | 1 | 1 | 0 | 0 | 1 | 0 | 1 | 06 | ** | WEAPON X HIT |
| 1 | 1 | 0 | 1 | 1 | 0 | 1 | 1 | 0 | 0 | 0 | 07 | 07 | TOW, SHILLELAGH, AT-6 (NTC HIND-D) HIT |
| 1 | 1 | 0 | 1 | 0 | 1 | 1 | 0 | 1 | 0 | 0 | 08 | 08 | DRAGON, SPANDREL (NTC BRDM-2) HIT |
| 1 | 1 | 0 | 1 | 1 | 0 | 0 | 1 | 0 | 0 | 1 | 09 | 09 | M202 FLAME HIT |
| 1 | 1 | 0 | 0 | 1 | 1 | 0 | 1 | 0 | 0 | 1 | 10 | 10 | M21 ANTITANK, 125 MM (NTC T72) HIT |
| 1 | 1 | 0 | 0 | 1 | 0 | 0 | 1 | 0 | 1 | 1 | 11 | 11 | CLAYMORE M81A1 AND M16 HIT |
| 1 | 1 | 0 | 1 | 0 | 1 | 1 | 0 | 0 | 1 | 0 | 12 | 12 | 105 MM HIT |
| 1 | 1 | 0 | 1 | 1 | 0 | 0 | 1 | 0 | 1 | 0 | 13 | 13 | 152 MM, 122 MM (NTC M1974) HIT |
| 1 | 1 | 0 | 0 | 1 | 0 | 1 | 1 | 0 | 0 | 1 | 14 | 14 | 2.75 INCH ROCKET, 57 MM ROCKET (NTC HIND-D), 73 MM (NTC-BMP) HIT |
| 1 | 1 | 0 | 1 | 0 | 1 | 0 | 1 | 1 | 0 | 0 | 15 | 15 | VIPER HIT |
| 1 | 1 | 0 | 0 | 1 | 0 | 1 | 0 | 1 | 0 | 1 | 16 | 16 | 120 MM HIT |
| 1 | 1 | 0 | 1 | 0 | 0 | 1 | 0 | 1 | 0 | 1 | 17 | 17 | 90 MM HIT |
| 1 | 1 | 0 | 0 | 1 | 1 | 0 | 0 | 0 | 1 | 1 | 18 | 18 | 8 INCH, 105 MM HOW, 122 MM, 155 HIT |
| 1 | 1 | 0 | 1 | 0 | 1 | 1 | 0 | 0 | 0 | 1 | 19 | 19 | 40 MM GRENADE HIT |
| 1 | 1 | 0 | 1 | 1 | 0 | 0 | 0 | 1 | 0 | 1 | 20 | 20 | ROCKEYE (CLUSTER BOMB) HIT |
| 1 | 1 | 0 | 1 | 1 | 0 | 1 | 0 | 1 | 0 | 0 | 21 | 21 | GAU-8 HIT |
| 1 | 1 | 0 | 0 | 0 | 1 | 1 | 0 | 0 | 1 | 1 | 22 | 22 | ZSU-23/4 VISUAL MODE (NTC), 25 MM, DIVAD, 23 MM (NTC-ZSU) HIT |
| 1 | 1 | 0 | 1 | 0 | 0 | 0 | 1 | 0 | 1 | 1 | 23 | 23 | VULCAN, AIRBORNE 20 mm, 30 MM (NTC HIND-D) HIT |
| 1 | 1 | 0 | 0 | 0 | 0 | 1 | 0 | 1 | 1 | 1 | 24 | 24 | M2, M85 MG HIT |
| 1 | 1 | 0 | 1 | 0 | 0 | 0 | 1 | 1 | 0 | 1 | 25 | 25 | CHAPARRAL HIT |
| 1 | 1 | 0 | 0 | 1 | 0 | 0 | 1 | 1 | 0 | 1 | 26 | 26 | STINGER HIT |
| 1 | 1 | 0 | 0 | 1 | 0 | 0 | 0 | 1 | 1 | 1 | 27 | 27 | M16 RIFLE, M60 MG, COAX MG HIT |
| 1 | 1 | 0 | 1 | 1 | 1 | 0 | 0 | 0 | 0 | 1 | 28 | 28 | HVY WEAPON MISS: 105 MM, 152 MM, 73 MM, VIPER, ETC. |
| 1 | 1 | 0 | 0 | 0 | 1 | 0 | 0 | 1 | 1 | 1 | 29 | 29 | LT WEAPON MISS: M16 RIFLE, M60 MG. COAX MG, ZSU-23/4, ETC. |
| 1 | 1 | 0 | 1 | 0 | 0 | 0 | 0 | 1 | 1 | 1 | 30 | 30 | LT WEAPON SPARE MISS, OPTICAL RESET |
| 1 | 1 | 0 | 1 | 0 | 1 | 0 | 0 | 0 | 1 | 1 | 31 | 31 | HVY WEAPON SPARE MISS |
| 1 | 1 | 0 | 1 | 0 | 0 | 1 | 1 | 0 | 0 | 1 | *32 | **32 | IFS ACTUATION |
| 1 | 1 | 0 | 1 | 0 | 1 | 0 | 0 | 1 | 0 | 1 | *33 | 06 | SA-14 (NTC) HIT |
| 1 | 1 | 0 | 1 | 1 | 0 | 0 | 0 | 0 | 1 | 1 | *34 | 05 | ZSU-23/4 (NTC) RADAR MODE HIT |
| 1 | 1 | 0 | 0 | 0 | 0 | 1 | 1 | 0 | 1 | 1 | *35 | **35 | |
| 1 | 1 | 0 | 1 | 1 | 0 | 1 | 0 | 0 | 0 | 1 | *36 | **36 | |
| 1 | 0 | 0 | 0 | 0 | 1 | 0 | 0 | 0 | 0 | 1 | 00 | 00 | BORESIGHT CODE (CONTINUOUSLY TRANSMITTED) |

37 CODES
11 BIT CODES
WEIGHT 6
*NOT USED IN STANDARD MILES EQUIPMENT
**NOT USED IN NTC EQUIPMENT
NTC = NATIONAL TRAINING CENTER

The MILES code as set forth hereinabove is normally transmitted on the laser beam at a 3 kilohertz rate. It may be noted that every code group has "1 1 0" as starting digits, or as a "header" This leaves 8 remaining bits or binary digits which are normally arranged with half of the remaining digits being 1's and half being 0's. Player identification numbers are often used in combination with MILES code numbers in order to identify the "player" who fired the weapon under consideration. The player identity is indicated by 11 bits of identification information interleaved with the 11 bits included in the MILES code structure, thus making a 22 bit number which is transmitted at a 6 kilohertz rate.

Figure 5:
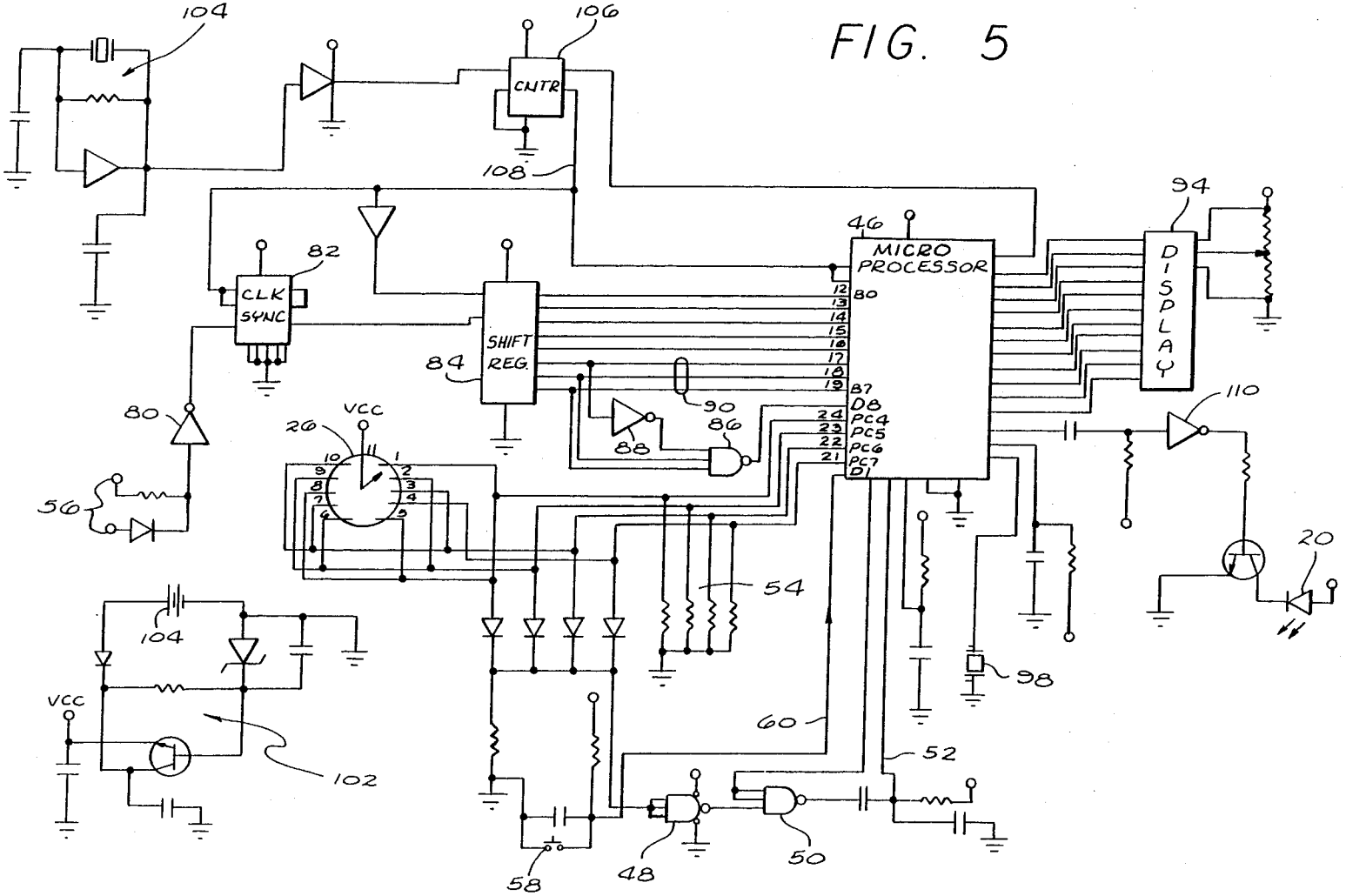
FIG. 5 is a detailed logic circuit diagram of one illustrative circuit which may be employed to implement the controller of the present invention.

Now, turning to FIGS. 4 and 5, the diagram of FIG. 4 indicates the mode of operation of the circuitry of the controller included in the housing 14 and shown in FIG. 5.

In FIG. 4, the block 42, designated "Initialize" indicates that the unit has been turned on by the operation of the on-off switch 24 to the "on" position and the circuitry of FIG. 5 has been set to an initialized condition. The next block 43 indicates that, following initialization, display shows the following display: "SIMULASER CORP; SEID8 REV #—"; and block 44 and the diamond 45 indicate that the circuitry is prepared to wait for an interrupt. Incidentally, included in the circuit diagram of FIG. 5, is the chip 46, which is an 8-bit microprocessor. When an interrupt has occurred, for example, by the rotation of the switch 26, shown both in FIG. 3, and also in FIG. 5, then a pulse is applied to the NAND gate 48, and this is coupled through the second NAND gate 50 and along lead 52 to input pin 2 to the microprocessor 46. Assuming that the unit is set to the "transmit" mode and is at the uppermost code in Table No. 1, the display 16 of FIG. 2 will show the following:

TRANSMIT
00 UNIV 0000

Of course, the top legend of the display indicates that the unit is in the transmit mode. Considering the second line of the display, the first two digits "00" is the standard MILES weapon code for "Universal Kill". The next four letters "UNIV" are an abbreviation for this code. The last four digits "0000" is the identification of the "player", or the source of the code to be transmitted.

When the 10 position switch 26 is stepped upwardly, the microprocessor 46 picks the next higher standard MILES code, and displays it, and is prepared to transmit it. Similarly, when the 10 position rotary switch 26 is stepped in the opposite direction, the next lower MILES code would appear in the display for transmitting. However, in addition to the 36 MILES code positions, the system, controlled by pulses from the switch 26, provides two additional modes for the controller unit, one being the "Receive" mode, and the other being the "I.D. Change" mode.

It may be noted that the output terminals from the 10 position switch 26 are coupled to the resistive network 54, and the outputs from these resistors are coupled to pins PC4 through PC7 of the microprocessor 46. Accordingly, following the receipt of an interrupt signal from the NAND circuits 48 and 50, the microprocessor scans the terminals PC4 through PC7 to determine whether the rotary switch 26 has been stepped in the clockwise (CW) or the counterclockwise (CCW) direction, so that the microprocessor may scroll the next MILES code onto the display, with either the next higher or the next lower MILES code being displayed, depending on the direction of operation of the rotary control switch 26. Similarly, above or below the 36 listings for the MILES codes, the microprocessor 46 will set the unit, including the corresponding display to either the "Receive" or to the "Identity Change" mode. It may be noted in passing that the processor 46 is programmable and includes a stored table of the MILES codes, and additional program information.

Incidentally, with reference to FIG. 5 of the drawings, the light-emitting diode 20 appears to the far right in the circuit diagram, while the input from the detector assembly 22, normally including a phototransistor or photodiode is supplied to the circuit at the terminals 56, at the left of FIG. 5.

Concerning another minor point, the 10 position mode selector could have been implemented with a rotary switch having a lesser number of positions; however, the switch 26 which was available, had a convenient multi-position mode of operation, and was therefore selected.

It may also be noted that the trigger switch 58 is shown at the lower central area of the diagram of FIG. 5. When the trigger switch 58 is energized, this supplies a signal on lead 60 to pin D1 of the microprocessor 46. As indicated below, the function of the trigger switch 58 is to change or advance the "player" identification code, or to output the MILES code from LED 20, depending on the mode of the system.

Continuing with a consideration of the mode of operation of the system as set forth in FIG. 4, it has been noted that the diamond 45 indicates that the system is awaiting an interrupt. If no interrupt occurs, the system remains in the state of awaiting the interrupt, as indicated by the flow line 47. If an interrupt does occur, as indicated by the "Y" (standing for "YES") at flow line 49, then the next step in the system is determined by the direction of rotation of the switch 26, and the resultant state of the system, as indicated by the block 51. Following the interrupt caused by the operation of the switch 26, diamond 53 asks the question, "Is the system in the receive mode?". If the system has indeed been put into the "receive" mode, we proceed to the block 55 indicating that the detector hybrid circuit coupled to terminals 56 is energized, and the system is operated to display the word "RECEIVE", as indicated by block 57. Blocks 59 and 61 indicate that the switch interrupt and the "receive" interrupt are now enabled. Diamond 63 inquires as to whether it is a switch interrupt, indicating operation of the switch 26. A "No" answer brings us to the decision diamond 65 which inquires as to whether the received signal has the proper lead-in code "110", indicating that a valid MILES code is being received. If not, the system reverts along line 67 to the input of diamond 63. However, if a valid MILES code is received, then block 69 indicates that the received message is decoded, and the MILES code and the identity of the "Player" which sent the MILES code is displayed. Following this step, the system returns as indicated by line 71 to the input of diamond 63, and meanwhile holds the first received MILES code signal until another MILES code signal is received, or until an interrupt occurs.

Now, returning to the output of diamond 53, if the system is not in the "RECEIVE" mode, we proceed to diamond 73 which inquires "Is the mode the ID change mode?". A "Yes" answer to this inquiry leads us to the block 75 indicating that the "ID Change" legend is displayed at the top of the unit. Blocks 77 and 79 indicate that the switch interrupt and the trigger interrupt are then energized. Diamond 81 inquires as to whether it is a switch interrupt, with a "yes" answer leading us along line 83 back to the input to block 51. On the other hand, a "no" answer to the inquiry of diamond 81 leads us to diamond 85 and the inquiry "Is it a trigger interrupt?". A "yes" answer to the inquiry of diamond 85 leads us to the block 87 calling for incrementing the player identification number on the display. The line 89 indicates a return to the input to diamond 81, which essentially means that the system is awaiting a switch change, to return to the "transmit" mode, or to the "receive" mode, for example; or another trigger interrupt, to again change the player I.D. number.

Returning to diamond 73, a "no" response indicates that we are in the third or "transmit" mode, as indicated by block 91. In this mode, the word "transmit" appears on the display, together with the specific MILES transmit code which has been selected. Block 93 indicates that the microprocessor now enables the switch interrupt, and the trigger interrupt inputs, with the trigger interrupt input involving the switch 58 as shown in FIG. 5 of the drawings. Diamond 95 inquires, "Is it a switch interrupt?", and a "yes" answer returns us to line 49 at the input of block 51. A "no" response brings us to the diamond 97 which poses the question, "Is it a trigger interrupt?". If not, the system is returned to the input of the diamond 95. A "yes" response causes the firing of the selected MILES code, together with the player identity code as indicated by the block 99. Following block 99, the system is returned to the input to block 93 wherein an additional pull of the trigger will again fire the code, and wherein a turning of the switch 26 will again shift the system back to the input of block 51, represented by the line 49.

Incidentally, with regard to switch interrupts, the microprocessor 46 checks pins PC4 through PC7, and determines whether there has been a change, and if so, in which direction the rotary control switch 26 has been rotated. When the switch 26 has been operated, the display is scrolled to a new MILES code, either higher or lower, depending on the direction of rotation of the switch 26, if the unit is in the "transmit" mode. Alternatively, if the rotation of the switch 26, takes the system beyond the highest or lowest MILES code, further stepping of switch 26 will shift the unit into the "receive" mode or into the "identity change" mode.

When the unit is in the receive mode, and an external signal has been received at the detection terminals 56 and has been routed through the inverter 80, the chip 82 which provides clock synchronization, the shift register 84 and the NAND circuit 86, responsive to the header bits "1 1 0", to provide an interrupt signal on terminal D8. Incidentally, the invertor circuit 88 inverts the signal on one of the three lines 90, so that all three inputs to the inverting AND or NAND circuit 86 are of the same polarity, in accordance with normal code recognition practices in digital logic circuitry. Following the receipt of the interrupt signal at terminal D8, the incoming MILES code which appears on leads 12 through 19 to the processor are read, with this action occurring after the three bit "header" has been shifted out of the shift register 84.

In the circuit diagram of FIG. 5, the display circuit 94 (see reference numeral 16 in FIG. 2) is shown coupled to the microprocessor 46. As mentioned hereinabove, the display 94 is a two line liquid crystal display, with 16 alpha-numeric characters in each line. These are available from a number of suppliers, with one suitable supplier being Densitron, a company located in Torrance, Calif. Block 69 in FIG. 4 indicates that the received code is displayed on the display unit 94.

Other circuits which are of interest in the circuit diagram of FIG. 5 include the horn or buzzer 98 which is energized when a MILES code is received, and the unit is in the "receive" mode, and when a MILES code is transmitted. Circuit 102, which includes the battery 104, is a power regulator circuit. The digital circuitry in the circuit of FIG. 5 is synchronous, and is controlled by the crystal oscillator 104 which operates at approximately 6.14 megahertz, and the counter 106 which brings the signal down to 48 kilohertz on line 108. The microprocessor 46 is available from a number of sources, including Motorola, under Part No. 68705. The other circuits are generally conventional, with the triangular symbol such as that shown at circuit 110 indicating an inverter. The remainder of the circuitry as shown in FIG. 5, is generally conventional, and may be implemented in accordance with known techniques by any person having normal skill in the digital electronic logic circuitry field.

Turning to another aspect of the present invention, it has been noted that the display as shown at 16 in FIG. 2, and at 94 in FIG. 5 includes two rows of 16 numbers or letters in each row. One typical transmit signal for the universal kill code was noted, and was set forth above in the text of this specification. Another typical display while the unit is in the transmit mode is as follows:

TRANSMIT
01 MAVRK 0001

The above display would indicate first that the unit is in the transmit mode, and second, that the signal to be transmitted is the standard MILES code No. "01" relating to a maverick hit, indicated by the abbreviation "MAVRK"; and the identity of the "player" is indicated by the number "0001".

When the unit is in the receive mode, it would merely have the single word "RECEIVE" appear on the upper line of the display. Following the actual receipt of a signal, the display would shift over to one such as the following:

MILES CODE ID
33 SA 14

This would indicate that the standard MILES code for the weapon is "33"; that the weapon is the SA14; and that the identity of the player is 0154.

Incidentally, when the controller unit is first turned on, the display is as follows:

IMULASER CORP
SE108 REV 52387

This indication refers to the Simulaser Corporation, the assignee of the present invention, a subsidiary of Applied Solar Energy Corporation, with the designation "SE108" referring to the controller unit part number, as described herein, and with the number "52387" indicating that the unit under consideration includes the revisions of May 23, 1987.

Concerning the frequency or wavelength of operation of the controller, it operates at a wavelength of approximately 880 nanometers, in the near infrared, compatible with existing MILES systems. It may be noted in passing that the visible spectrum is from about 400 nanometers to about 700 nanometers. The detector assembly 22 includes an outer plastic shield which protects the photodiode mounted within the shield, and also serves as a filter to avoid energization of the photodiode by incident light other than radiation in the near infrared band.

In conclusion, it is to be understood that the foregoing detailed description and the accompanying drawings relate to an illustrative embodiment of the invention. Various changes and modifications may be made without departing from the spirit and scope of the invention. Thus, by way of example and not of limitation, the unit need not be in a pistol grip configuration, although this form is preferred. Alternatively, the unit may be in the form of a rectangular box, or in the form of another weapon other than the pistol configuration. With regard to the electronic circuitry as shown in FIG. 5 of the drawings, the functions of this circuit as described herein may be implemented by other logic circuits and digital circuitry which are equivalent to that shown in FIG. 5. It is also noted that, instead of transmitting signals with an output light emitting diode, a laser may be employed, as the light emitting element. Accordingly, the present invention is not precisely limited to the system as shown in the drawings and as described in detail hereinabove.

What is claimed is:

1. A pistol style controller unit for use with Multiple Integrated Laser Engagement System (MILES) type simulated warfare systems comprising:

a pistol style housing and handle;

detector means mounted on said housing for receiving input coded MILES signals;

light emitting means for transmitting coded MILES signals including both a weapons code and an identity code;

switching means on said housing for switching said unit between transmit and receive modes of operation, and for selecting weapons type information to be transmitted;

liquid crystal display means mounted on said housing for displaying information to be transmitted by said light emitting means when said unit is in the transmit mode; and for displaying information identifying the received signals when said unit is in the receive mode; and electronic circuit means mounted within said housing for processing incoming signals received by said detector means when said unit is in the receive mode, and for applying signals to said displaying means indicating weapons type, and any source identity, if any; and for causing signals to be transmitted from said light emitting means corresponding to the displayed weapon type and source identity, when said unit is in the transmit mode.

2. A pistol style controller unit as defined in claim 1 wherein said unit includes trigger switch means for initiating transmission of MILES Code signals.

3. A pistol style controller unit as defined in claim 1 further including means for providing identity codes, and said system including means for transmitting said identity codes interleaved with the MILES weapons codes.

4. A pistol style controller unit as defined in claim 3, wherein said controller unit and its electronic circuit means include means for providing both a transmit mode and an "identity change" mode for said unit; and further including means for switching said unit into the "identity change" mode; and trigger switch means for changing the identity code when said unit is in the identity change mode.

5. A pistol style controller unit as defined in claim 1 further comprising plastic shield means for protecting said detector means and for filtering incoming radiation.

6. A pistol style controller unit as defined in claim 1 further including audio signalling means coupled to said circuit means for indicating the receipt and transmission of a MILES code signal.

7. A pistol style controller unit as defined in claim 1 wherein said display is mounted on the top of said pistol style unit, the photo-detector and the light-emitting means are mounted on the front, and said switching means is mounted on the rear, of said unit.

8. A pistol style controller unit as defined in claim 1 wherein said light emitting means is a light emitting diode.

9. A portable controller unit for use with Multiple Integrated Laser Engagement System (MILES) type simulated warfare systems, comprising:

photo-detector means for receiving input coded MILES signals;

light-emitting means for transmitting coded MILES signals including both a weapons code and an identity code;

switching means for switching said unit between transmit and receive modes of operation, and for selecting weapons type information to be transmitted;

means for displaying information identifying information to be transmitted by said light-emitting means when said unit is in the transmit mode; and for displaying information identifying the received signals when said unit is in the receive mode; and electronic circuit means for processing incoming signals received by said detector means when said unit is in the receive mode, and for applying signals to said displaying means indicating weapons type; and for causing signals to be transmitted from said light-emitting means corresponding to the displayed weapon type and source identity, when said unit is in the transmit mode.

10. A portable controller unit as defined in claim 9 wherein said unit includes trigger switch means coupled to said electronic circuit means for initiating transmission of MILES Code signals.

11. A portable controller unit as defined in claim 9 further including means for providing identity codes, and said system including means for transmitting said identity codes interleaved with the MILES weapons codes, included in said electronic circuit means.

12. A portable controller unit as defined in claim 11 wherein said controller unit and its electronic circuit means includes means for providing both a transmit mode and an "identity change" mode for said unit, and further including means for switching said unit into the "identity change" mode, and trigger switch means for changing the identity code when said unit is in the identity change mode.

13. A portable controller unit as defined in claim 9 further comprising plastic shield means for protecting said detector means and for filtering incoming radiation.

14. A portable controller unit as defined in claim 9 further including audio signalling means coupled to said electronic circuit means for indicating the receipt of a MILES code signal.

15. A pistol style controller unit for use with coded light ray type systems, comprising:

a pistol style housing and handle;

photo-detector means mounted on said housing for receiving input coded signals;

light-emitting means mounted on said housing for transmitting coded signals;

switching means mounted on said housing for switching said unit between transmit and receive modes of operation, and for selecting digital information to be transmitted;

means on said housing for displaying information to be transmitted by said light-emitting means when said unit is in the transmit mode; and for displaying information identifying the received signals when said unit is in the receive mode; and electronic circuit means mounted in said housing for processing incoming signals received by said detector means when said unit is in the receive mode, and for applying signals to said displaying means indicating the incoming coded information; and for causing signals to be transmitted from said light-emitting means corresponding to the displayed information, when said unit is in the transmit mode.

16. A pistol style controller unit as defined in claim 15 wherein said unit includes trigger switch means mounted on said housing for initiating transmission of coded signals.

17. A pistol style controller unit as defined in claim 15 further comprising plastic shield means for protecting said detector means and for filtering incoming irradiation.

18. A pistol style controller unit as defined in claim 15 further including audio signalling means coupled to said electronic circuit means for indicating the receipt of an incoming coded signal.

19. A pistol style controller means as defined in claim 15 wherein said display is mounted on the top of said pistol style unit, the photo-detector and the light-emitting means are mounted on the front and said switching means are mounted on the rear of said unit.

* * * * *